US007856114B2

(12) United States Patent
Belanger et al.

(10) Patent No.: US 7,856,114 B2
(45) Date of Patent: Dec. 21, 2010

(54) MAGNETIC SPEAKER GRILL

(75) Inventors: Donald Belanger, Chula Vista, CA (US); Guillermo Escobar, Chula Vista, CA (US)

(73) Assignee: KSC Industries, Inc., Chula Vista, CA (US)

( * ) Notice: Subject to any disclaimer, the term of this patent is extended or adjusted under 35 U.S.C. 154(b) by 1157 days.

(21) Appl. No.: 11/507,909

(22) Filed: Aug. 21, 2006

(65) Prior Publication Data

US 2008/0044053 A1 Feb. 21, 2008

(51) Int. Cl.
*H04R 1/02* (2006.01)

(52) U.S. Cl. ..... 381/391; 381/386

(58) Field of Classification Search ..... 181/150, 181/199; 381/386, 389, 391, 395
See application file for complete search history.

(56) References Cited

U.S. PATENT DOCUMENTS 4,071,111 A 1/1978 Croup
4,331,841 A 5/1982 Castagna
5,652,413 A 7/1997 Mulera
6,101,262 A 8/2000 Haase et al.
6,142,254 A 11/2000 Claybaugh et al.
6,305,892 B1 10/2001 Qiao
6,354,397 B1 3/2002 Combest et al.
2006/0177088 A1 8/2006 Howard et al.

OTHER PUBLICATIONS

Soundtube, Installation Instructions for CMi Series in-ceiling speakers, pp. 1-4.
Soundtube, Webpage regarding technical information for Model CM590i in-ceiling speaker, pp. 1-2.

*Primary Examiner*—Tuan D Nguyen
(74) *Attorney, Agent, or Firm*—Knobbe Martens Olson & Bear LLP

(57) ABSTRACT

A speaker assembly having a removable grill. The grill includes a perforated portion circumscribed by a flange. The flange has one or magnets disposed around an outer periphery of the flange. The speaker body has corresponding slugs disposed so as to align with the magnets of the grill upon assembly. The magnetic bond formed between the slugs and magnets keeps the grill attached to the speaker body during operation of the speaker assembly.

20 Claims, 5 Drawing Sheets

MAGNETIC SPEAKER GRILL

BACKGROUND OF THE INVENTION

1. Field of the Invention

The present invention relates to speakers and, in particular, to covers for speakers such as grills.

2. Description of the Related Technology

The popularity of ceiling and wall-mounted speakers in various types of buildings has steadily grown over the past decade. A variety of methods and devices for mounting speakers in these locations have therefore been developed. To install an in-wall speaker an installer cuts a hole in the wall or ceiling to receive the outer frame of the speaker. A strap or bracket may be mounted to the framing of the wall or ceiling behind the outer surface of the wall. The speaker body includes an outer flange that extends around the speaker and provides a contact or resting surface with the outer surface of the wall. The speaker is inserted into the hole so that the flange rests against the wall. The flange is then secured to the wall with fasteners.

Finally, the installer presses a grill over the speaker covering the speaker components and fasteners. The grill provides the speaker with an aesthetically pleasing appearance while being substantially acoustically transparent. Besides covering the fasteners and providing a clean appearance for the speaker, certain speakers include user selectable switches behind their grills. For example, a crossover switch may be mounted behind the grill to allow a user to select a frequency cross-over point for one or more drivers of the speaker. Some speakers have adjustable pivoting transducers to allow a user to direct the sound coming from the speaker. Some loudspeakers are designed with multi-tap transformers with a user adjustable switch or knob mounted behind the grill. Accordingly, it is preferred to releasably fasten the grill to the speaker so as to allow the user to remove and replace the grill to access these switches or controls. A common method for releasably attaching wall mounted speakers is to press-fit a rearward extending flange into a circumferential groove in a baffle of the speaker so a to form a friction fit.

One of the problems with removing and replacing the grill is the interference or friction fit between the baffle and flange diminishes over time due to handling of the grill. The force of the friction fit can weaken the memory of the rearward facing flange and cause the grill to become loose. In some cases the grill may vibrate or buzz during speaker operation and possibly may simply fall out of the baffle. Therefore, there exists a need for a design that will address these problems.

SUMMARY OF THE INVENTION

The systems and methods of the present invention have several features, no single one of which is solely responsible for its desirable attributes. Without limiting the scope of this invention as expressed by the claims which follow, its more prominent features will now be discussed briefly. After considering this discussion, and particularly after reading the section entitled "Detailed Description of the Preferred Embodiments" one will understand how the features of this invention provide several advantages over traditional speaker systems.

One aspect of the present invention is a speaker that comprises a perforated grill and a flange supporting the grill. The flange has one or more magnets disposed on the flange. The speaker further comprises a body having one or more slugs disposed so as to form a magnetic bond with the one or more magnets when the flange is in close proximity to the body.

Another aspect is an inwall speaker that comprises an aluminum portion having a plurality of perforations. The speaker further comprises a flange that supports the aluminum portion and has a first plurality of metallic members disposed around a periphery of the flange. The speaker further comprises a speaker body that has a second plurality of metallic members disposed so as to form one or more magnetic bonds with the first plurality of metallic members when the flange is in close proximity to the speaker body.

DETAILED DESCRIPTION OF THE PREFERRED EMBODIMENTS

Figure 1:
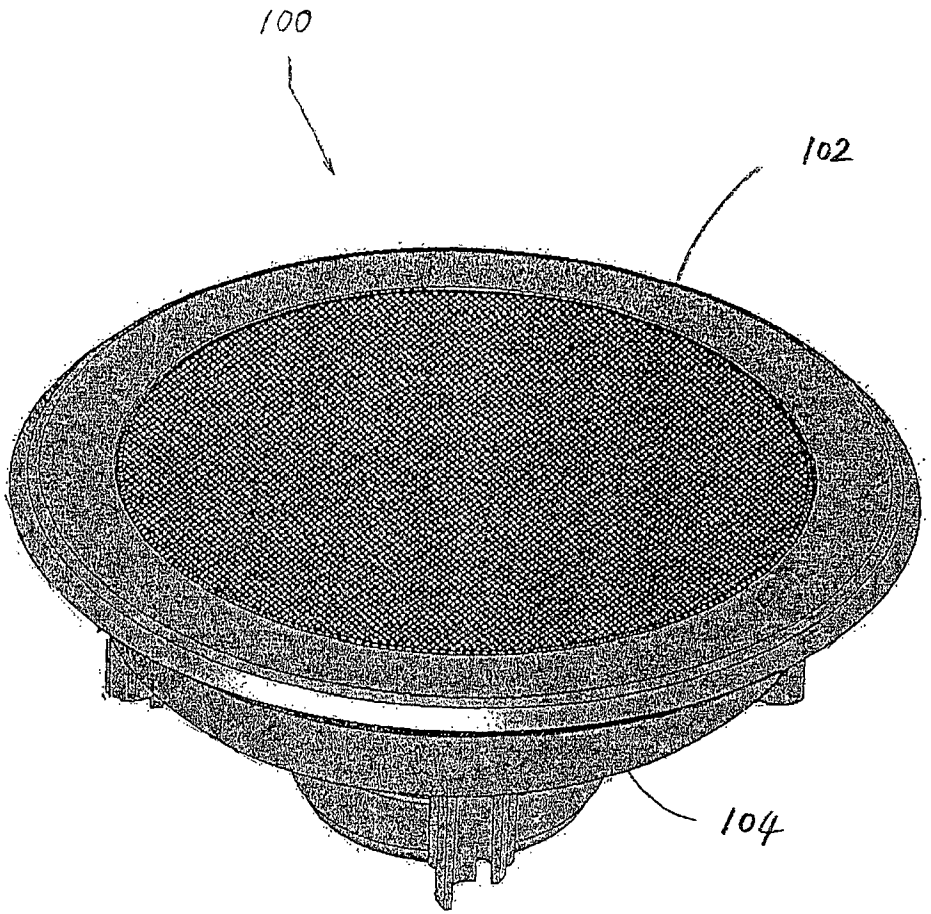
FIG. 1 is a perspective view of a speaker assembly according to a preferred embodiment of the present invention.

Embodiments of the invention will now be described with reference to the accompanying figures, wherein like numerals refer to like elements throughout. The terminology used in the description presented herein is not intended to be interpreted in any limited or restrictive manner simply because it is being utilized in conjunction with a detailed description of the preferred embodiments of the invention. Furthermore, embodiments of the invention may include several novel features, no single one of which is solely responsible for its desirable attributes or which is essential to practicing the inventions herein described.

Perforated metal grills are desirable for in-ceiling and in-wall speakers because they provide a clean appearance and tend to hold their shape even when repeatedly removed and replaced on the speaker body. It still may be difficult to install and remove a metal grill. Further, it has been found that stronger materials, such as steel, are more resistant to permanent deformation and maintain their friction fit with the speaker baffle over time.

However, it is not uncommon for the rearward facing flange of the grill to fit too tightly or loosely into the speaker baffle because of the tolerances associated with manufacturing. When the grill is too tight, the installer deforms the rearward facing grill flange inward to align the flange with the groove in the baffle. If the grill is too loose, the installer deforms the natural round shape of the grill to an oval shape so as to increase the interference between the groove and the rearward facing flange. Even if an adequate fit is achieved between the rearward facing flange and the baffle, the fit may be lost over time as the user removes and replaces the grill to access the switches or controls located behind the grill. Installation and removal is even more problematic when the speaker is an in-ceiling speaker requiring the installer or user to work over their head while standing on a ladder.

Even though steel grills are preferred over weaker metals such as aluminum for the reason discussed above, steel has its own disadvantages. For example, a steel grill is apt to rust over time in environments prone to exposure to excessive humidity or salt water. While speakers include other steel components which may also rust over time, the grill is the only component that is visible to the user. In this case, a non-ferrous material such as aluminum would be preferred notwithstanding the disadvantages of using a weaker material discussed above.

Certain embodiments as will be described below relate to a speaker having a grill assembly that may be easily attached to the speaker body. The preferred embodiment of the grill assembly includes one or more magnets disposed around an outer surface or periphery of the grill. The magnet may be a permanent magnet or an electromagnet that generates an electric filed. For speaker embodiments having an electromagnet, an electric current is applied to the electromagnet. Upon application of the electric current, the electromagnet generates the magnetic field. The speaker body includes one or more corresponding members or slugs disposed so as to align with the magnets of the grill assembly. The slug may be a metal or other material that is attracted to a magnetic field. A magnetic bond is formed between the slugs and magnets and secures the grill assembly to the speaker body.

FIG. 1 is a perspective view of a speaker assembly 100 according to a preferred embodiment of the present invention. The speaker 100 includes a grill assembly 102 and a speaker body 104. The speaker body 104 is secured to the wall or ceiling. The grill assembly 102 is attached to the speaker body 104. The speaker may be in-wall, freestanding, bookshelf or other type of speaker. The grill assembly 102 is generally a protective or decorative cover for the speaker body 104. The grill assembly 102 may be of any shape appropriate for the purpose of use. For example, it may be rectangular, oval, round, square, triangular, or of any other geometric shape. The outer circumference of the speaker body 104 generally defines size and shape for the hole or space that receives the speaker assembly 100.

Figure 2:
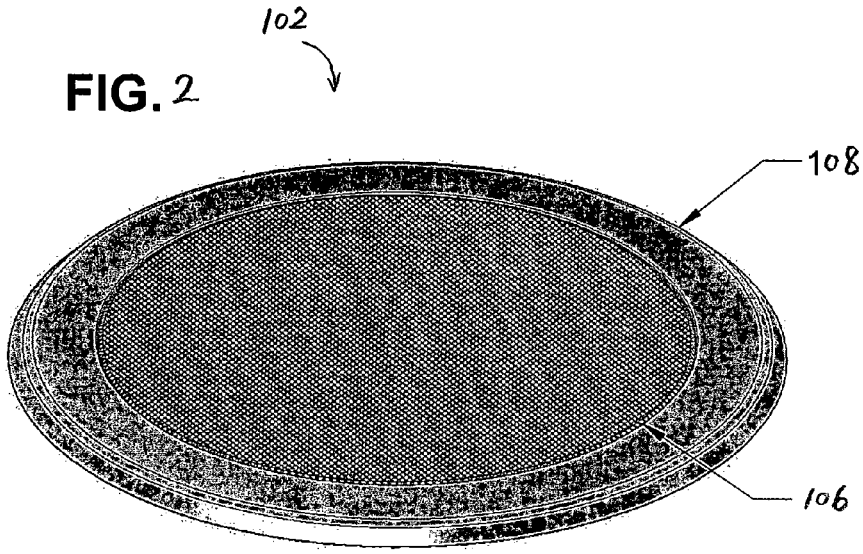
FIG. 2 is a top perspective view of a speaker grill from FIG. 1.

FIG. 2 is a top perspective view of a speaker grill assembly 102 from FIG. 1. The grill assembly 102 includes a grill 106, a flange 108, and one or more magnets 112. The grill 106 may be made of aluminum, steel, brass, plastic, cloth, or any other substantially acoustically transparent material. In some preferred embodiments, the grill 106 is made of a non-corrosive material, such as aluminum. Such embodiments are particularly useful when the speaker 102 is designed for environments prone to exposure to excessive humidity or salt water. Preferably, at least a portion of the grill 106 is perforated. Though the grill 106 is shown to be round, it may be in any other geometric shape appropriate for the purpose of use.

The grill 106 may or may not be fixedly attached to the flange 108. The grill 106 and flange 108 may be a unitary piece. The flange 108 may be made of, but not limited to, plastic, metal, and/or other similar materials. In one advantageous embodiment, the flange 108 is made of plastic and fixedly attached to an aluminum grill 106 around the inside diameter of the flange 108.

Figure 3:
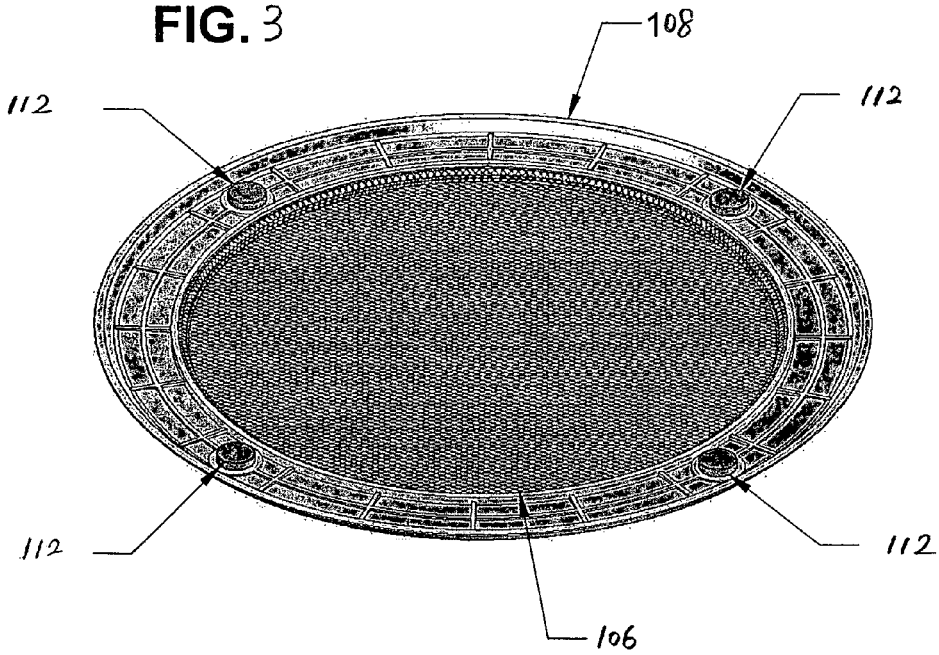
FIG. 3 is a bottom perspective view of the speaker grill from FIG. 2 showing magnets attached around the periphery of the grill.

FIG. 3 is a bottom perspective view of the speaker grill 106 from FIG. 2 showing a plurality of magnets 112 attached to the grill flange 108. The magnet 112 is an object that has a magnetic field and can be in the form of, for example, a permanent magnet or an electromagnet.

In the illustrated embodiment, the bottom surfaces of the magnets 112 are attached to the underside of the flange 108 while the top surfaces of the magnets 112 are left exposed. The exposed surfaces of the magnets 112 are brought in close proximity to the speaker body 104 so as to attract a material of the speaker body 104 that has a degree of magnetization that responds to the magnetic field of the magnet 112. For example, slugs made of iron, steel, and the like have a sufficient degree of magnetization. In certain embodiments, the location of the one or more of the magnets 112 are switched so that the magnet 112 is attached to the speaker body 104 and the slug is attached to the grill flange 108.

Though the magnets 112 are shown to be round, they may be of any other geometric shape. In the exemplary embodiment, four magnets are positioned around an outer periphery of the flange 108. The number and arrangement of magnets may be changed in any way which permits a stable attachment between the grill assembly 102 and the speaker body 104. In some embodiments, at least two magnets are desirable in order to permit a stable attachment. In other embodiments, a single magnet that extends around a substantial portion of the circumference of the flange 108 is employed. The magnets 112 may be attached to the flange 108 by various means known in the art. For example, the magnets 112 may be insert-molded into the flange 108 or attached to the flange 108 with an adhesive. In the illustrated embodiment, the top surface of the magnet 112 is disposed above the adjacent surface of the flange 108.

Figure 4:
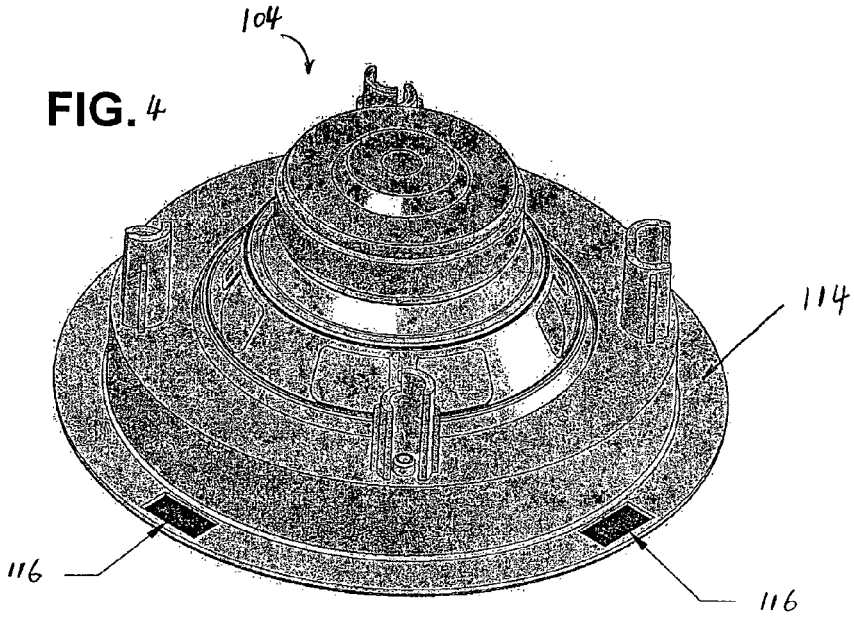
FIG. 4 is a bottom perspective view of the speaker body from FIG. 1 showing a plurality of slugs mounted around the periphery of the speaker body.

FIG. 4 is a bottom perspective view of the speaker body 104 from FIG. 1 showing one or more slugs 116 mounted around the periphery of the speaker body 104. In the illustrated embodiment, the slugs 116 are attached to a flange 114 of the speaker body 104. The slugs 116 may be made of iron, steel or other material having a degree of magnetization that responds to the magnetic field of the magnet 112.

Figure 5:
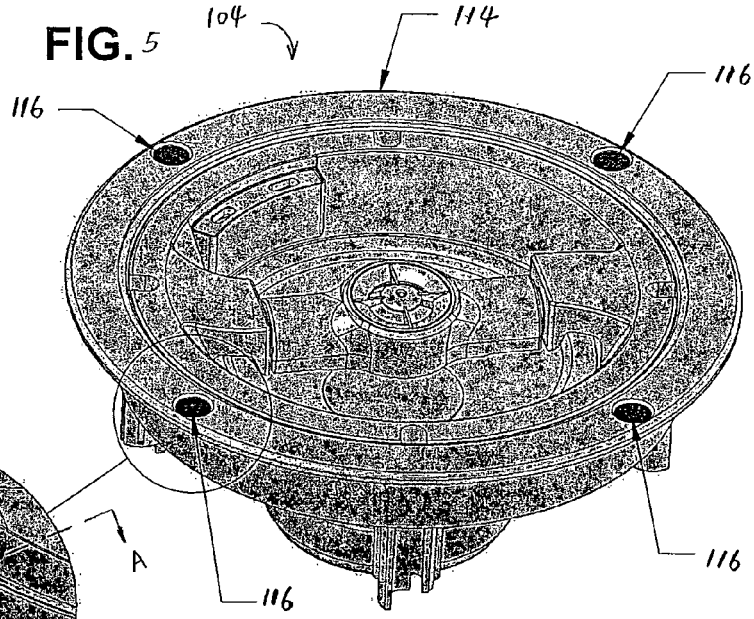
FIG. 5 is a top perspective view of the speaker body from FIG. 4 showing a mating side of the plurality of slugs.

FIG. 5 is a top perspective view of the speaker body 104 from FIG. 4 showing a mating side of the plurality of slugs 116. The slugs 116 are attached such that at least a portion of each slug is accessible from the side of the flange 114 that is exposed when the speaker body 104 is installed into the wall or ceiling. The slugs 116 may or may not be permanently attached to the flange 114. For example, the slugs 116 may be insert-molded into the flange 114. The slugs 116 may be attached to the bottom side of the flange 114 so that a portion of the slug 118 is exposed from the topside of the flange 114. The slugs 116 are aligned with the magnets 112 (see FIG. 3) so that the magnets 112 come in contact with the slugs 116 when the grill assembly 102 is brought into close proximity to the speaker body 104. In the exemplary embodiment, each slug 116 aligns with one magnet 114 upon attachment.

Figure 6:
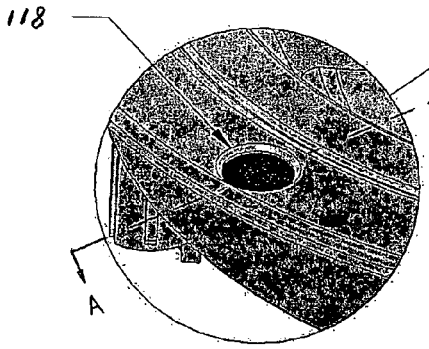
FIG. 6 is an enlarged view of one of the slugs from FIG. 5 showing the mating side recessed below the top surface of the speaker flange.

FIG. 6 is an enlarged view of one of the slugs 116 from FIG. 5 showing the top side or mating side recessed below the top surface of the speaker flange 114. In the exemplary embodiment, the flange 114 comprises a thru hole 118 which exposes a portion of the top surface of the slug 116. As shown by comparing FIGS. 4 and 6, the lateral ends of the slug 116 are not visible through the hole 118 and provide a mating surface for attaching the slug 116 to the flange 114. The thru holes 118 may also be replaced by counterbores such that the slugs 116 are inserted into the counterbores from the topside of the flange 114.

Figure 7:
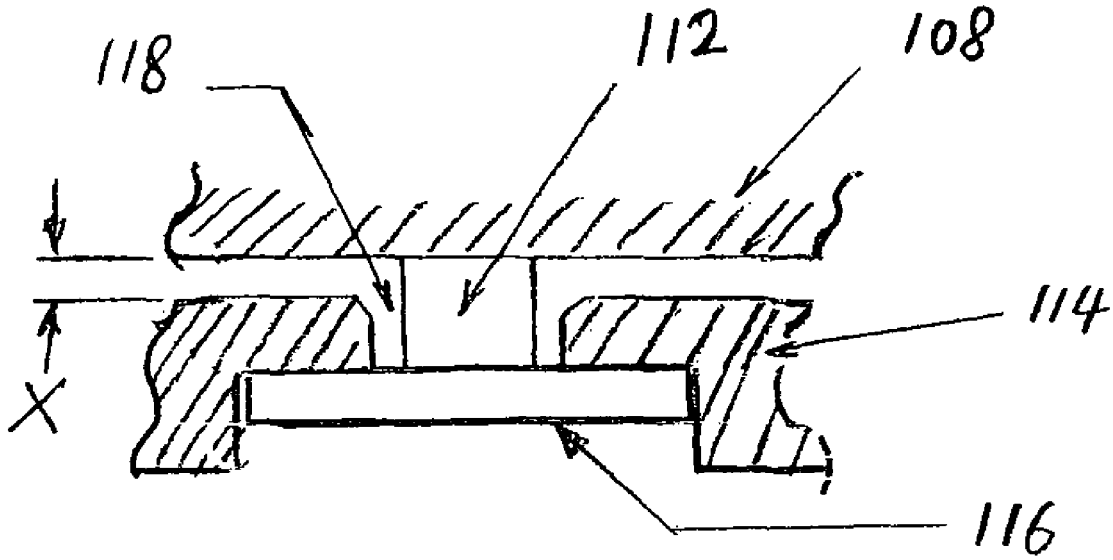
FIG. 7 is cross-section view taken along lines A-A from FIG. 6 with the speaker grill installed on the speaker body and showing a gap between the mating surface of the speaker grill and speaker body when the magnet contacts the slug.

FIG. 7 is cross-section view taken along lines A-A from FIG. 6 with the speaker grill flange 108 installed on the speaker body flange 114 and showing a gap X between the mating surfaces of the flanges 108, 114 when the magnet 112 contacts the center portion of the slug 116. The gap X mechanically isolates the speaker body flange 114 from the grill assembly while allowing the magnet 112 to contact the slug 116. This arrangement maximizes the force of attraction between the magnet 112 and slug 116 and reduces the chance that, for example, tolerance variations of the flanges 108, 114 prevent the magnets 112 from coming in close enough contact with the slugs 116 to achieve an adequate attractive force. Of course the invention is not limited to embodiments that have a gap X as long as the degree of attraction between the one or more magnets 112 and the one or more slugs 116 is sufficient to maintain the grill 102 on the speaker body 104 during operation of the speaker.

In the exemplary embodiment, the magnet 112 is exposed through the thru hole 118 and comes in mechanical contact with the slug 116. The remainder of the grill flange 108 is not in mechanical contact with, but still in close proximity to, the speaker flange 114. The dimensions of the components of the speaker assembly 100 may be adjusted to accommodate the tolerances associated with mass production. In embodiments having a thru hole 118, the slugs 116 and the magnets 112 are insulated from open air exposure upon assembly and therefore protected from corrosion.

Figure 8:
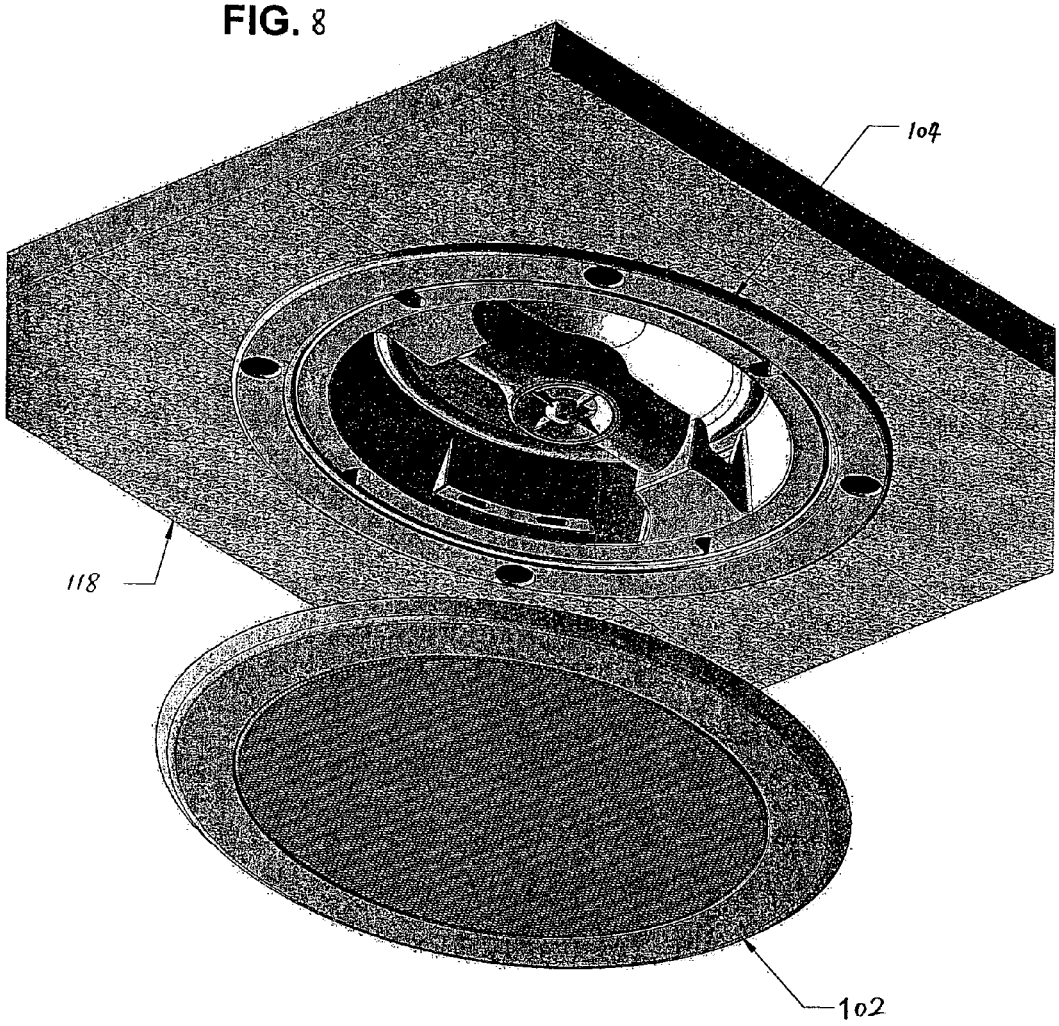
FIG. 8 is an exploded perspective view of the speaker assembly from FIG. 1 with the speaker grill aligned with the speaker body.

FIG. 8 is an exploded perspective view of the speaker assembly 100 from FIG. 1 showing the speaker grill 102 aligned with the speaker body 104. In the illustrated embodiment, the speaker body 104 is installed in a ceiling 118. However, the invention is not so limited. The speaker body 104 may be installed in a stand alone enclosure, wall or the like.

The installer may initially coarsely align the grill assembly 102 with the speaker body 104. The installer may or may not precisely clock the magnets on the grill 10 with the slugs on the speaker body 104. If the installer clocks the magnets to the slugs, the grill 102 may not need to be rotated after the grill assembly 102 contacts the speaker flange 114. If the installer does not clock the magnets 112 relative to the slugs 116 or if the magnets 112 are not close enough to the slugs 116 to attract the slugs 116 when the grill 102 is against the flange 114, the installer may simply rotate the grill 102 until the magnets come in close proximity to the slugs 116.

Once the magnets 112 are close enough that the slugs 116 are magnetically attracted to the magnets 112, the magnetic attraction or force snaps the grill assembly 102 into place. The snapping of the grill assembly 102 into place provides a physical and audible confirmation to the installer that the installation is complete. As described above, mechanical contact may be limited to the magnets 112 and slugs 116. In other embodiments, the grill flange 108 is in contact with the speaker flange 114 with or without mechanical contact between the magnets 112 and slugs 116. By utilizing magnets 112 for the mechanical interface, the contact between the other components of the grill assembly 102 and the speaker body 104 is minimized so as to reduce any mechanical buzzing or vibration of the speaker grill 102.

In some embodiments, the outside diameter of the grill assembly 102 is slightly larger than of the speaker body 104. With such an embodiment, the grill assembly 102 overhangs the speaker body 104. The overhang self centers the grill assembly 102 over the speaker body 104 and also makes removal of the grill assembly 104 easy. The installer simply needs to slip a small screwdriver, the tip of fingers, or similar tool under the outer lip of the grill assembly 104 to pry it off by breaking the magnetic bond between the magnets 112 and slugs 116.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A speaker comprising:

a perforated grill comprising aluminum;

an aluminum flange supporting the grill and having one or more magnets disposed on the flange; and a body having one or more slugs disposed so as to form a magnetic bond with the one or more magnets when the flange is in close proximity to the body.

2. The speaker of claim 1, wherein the grill is acoustically transparent.

3. The speaker of claim 1, wherein the body further comprises a thru hole, at least a portion of the slug being exposed through the thru hole.

4. The speaker of claim 3, wherein at least a portion of the magnet is inserted into the thru hole and contacts the slug so as to inhibit rotation of the grill.

5. The speaker of claim 4, wherein the inserted magnet provide a degree of snap fit with the thru hole so as to clock the grill with respect to the body.

6. The speaker of claim 1, wherein an outside diameter of the flange is larger than an outside diameter of the body so that when the grill is installed on the body a lip is formed around the flange.

7. The speaker of claim 1, wherein the speaker is adapted for mounting in a ceiling.

8. The speaker of claim 1, wherein the speaker is adapted for mounting in a wall.

9. The speaker of claim 1, wherein the slugs and the magnets are disposed so as to align with each other when the grill is installed on the body.

10. The speaker of claim 1, wherein the magnetic bond provides a stable mechanical connection between the flange and the body.

11. The speaker of claim 1, wherein a gap is present between the flange and body when the flange is installed on the body.

12. The speaker of claim 1, wherein the slugs contact the magnets.

13. An inwall speaker comprising:

an aluminum portion having a plurality of perforations;

an aluminum flange supporting the aluminum portion and having a first plurality of metallic members disposed around a periphery of the flange; and a speaker body having a second plurality of metallic members disposed so as to form one or more magnetic bonds with the first plurality of metallic members when the flange is in close proximity to the speaker body.

14. The speaker of claim 13, wherein the aluminum portion is acoustically transparent.

15. The speaker of claim 13, wherein the first plurality of metallic members are magnets and the second plurality of metallic members are slugs.

16. The speaker of claim 13, wherein the first plurality of metallic members are slugs and the second plurality of metallic members are magnets.

17. The speaker of claim 16, wherein the slugs and the magnets contact each other when the flange is in close proximity to the speaker body.

18. The speaker of claim 17, wherein only the magnets of flange contact the speaker body.

19. The speaker of claim 13, wherein a first portion of an upper surface of the second plurality of metallic members contacts the speaker body, and wherein a second portion of the upper surface contacts the first plurality of metallic members when the flange is in close proximity to the speaker body.

20. The speaker of claim 13, wherein an outside diameter of the flange is larger than an outside diameter of the speaker body so that when the flange is installed on the speaker body a lip is formed around the flange.

* * * * *